US008330063B2

(12) United States Patent
Xiao

(10) Patent No.: US 8,330,063 B2
(45) Date of Patent: Dec. 11, 2012

(54) EXTERNAL HANGING COMBINED VACUUM ON-LOAD TAP SWITCH

(75) Inventor: Riming Xiao, Shanghai (CN)

(73) Assignee: Shanghai Huaming Power Equipment Co., Ltd. (CN)

( * ) Notice: Subject to any disclaimer, the term of this patent is extended or adjusted under 35 U.S.C. 154(b) by 883 days.

(21) Appl. No.: 12/392,242

(22) Filed: Feb. 25, 2009

(65) Prior Publication Data

US 2009/0211890 A1 Aug. 27, 2009

(30) Foreign Application Priority Data

Feb. 26, 2008 (CN) ..... 2008 1 0033900

(51) Int. Cl.
*H01H 25/00* (2006.01)

(52) U.S. Cl. ..... 200/337; 200/11 TC

(58) Field of Classification Search ..... 200/337
See application file for complete search history.

(56) References Cited

U.S. PATENT DOCUMENTS

| | | | | |
|---|---|---|---|---|
| 3,360,318 | A * | 12/1967 | Studinski | 312/217 |
| 3,612,786 | A * | 10/1971 | Whitman | 200/11 TC |
| 3,632,908 | A * | 1/1972 | Bleibtreu et al. | 200/11 TC |
| 4,214,250 | A * | 7/1980 | Fujita et al. | 346/145 |
| 4,595,806 | A * | 6/1986 | Itoh | 200/11 TC |
| 6,693,247 | B1 * | 2/2004 | Byers et al. | 200/11 TC |
| 7,750,257 | B2 * | 7/2010 | Lindsey et al. | 200/11 TC |

* cited by examiner

*Primary Examiner* — Elvin G Enad
*Assistant Examiner* — Lisa Homza
(74) *Attorney, Agent, or Firm* — Wilmer Cutler Pickering Hale & Dorr LLP.

(57) ABSTRACT

The invention relates to an external hanging combined vacuum on-load tap switch, comprising a case, a tap selector, a switching means assembly, a transmission device, and one electric operation mechanism, wherein one lateral side wall of the case is provided with a connecting terminal connected with the coil tap of a transformer; the external side of the wall is provided with a first flange plate and is connected with a second flange plate of the transformer; the tap selector and the switching means assembly are arranged inside the case in parallel; and the electric operation mechanism is connected with the transmission device and drives the tap selector and the switching means assembly to achieve tapping and switching through the transmission device.

7 Claims, 14 Drawing Sheets

- - PRIOR ART - -

EXTERNAL HANGING COMBINED VACUUM ON-LOAD TAP SWITCH

CROSS REFERENCE TO RELATED APPLICATION

This application claims the benefit of priority under 35 U.S.C. §119(a) to Chinese Patent Application No. 200810033900.0, filed Feb. 26, 2008, which is hereby incorporated by reference in its entirety.

FIELD OF THE INVENTION

The invention relates to an on-load tap switch, and more specifically, to an external hanging combined vacuum on-load tap switch used to accompany a transformer.

BACKGROUND

The on-load tap switch changes the primary and secondary ratio of transformer windings by switching the multi-tap transformer from one tap to another when the transformer is loaded, thereby changing the output voltage of the transformer.

In the prior art, the combined on-load tap switch usually includes a switching means and a tap selector. Generally speaking, the switching means is arranged at the top, while the tap selector is arranged at the bottom, and the switching means and the tap selector are arranged co-axially and mechanically connected. The combined on-load tap switch is placed into the oil tank of the transformer from the flange hole positioned on the upper cover of the transformer.

The combined on-load tap switch usually takes on a column form and is sealed inside an independent column oil chamber, while the tap selector takes on a cage-shaped structure with a plurality of connecting terminals, which are used for connecting correspondingly with the coil tap of the transformer and submerged in the insulation medium contained in the oil tank of the transformer.

The above mentioned structure has following disadvantages:

(1) A space needs to be reserved in the transformer for the switch, thereby increasing the volume of the transformer;

(2) The failure maintenance and regular examination for the switch are relatively troublesome, as the transformer needs to be fully discharged with oil and covered with suspension, thus resulting in relatively a high maintenance cost and long maintenance time; and (3) The transformer may be polluted from potential leakage or damage in the oil chamber containing the switch, thereby causing unforeseen losses and further problems.

The prior external hanging on-load tap switch includes a combined on-load tap switch which only combines switching and selecting functions, that is, a transition contactor, an arc contactor, a transition resistor and a main contactor are combined in a movable contactor assembly, thereby achieving the operation of transitioning and switching through the rotation of the main shaft of the switch.

As shown in FIG. 1, a combined switch includes an auxiliary contactor 11, a main contactor 12, a transition contactor 13 and a transition resistor 15, which are combined and assembled on a movable contactor bracket 14 to form a movable contactor assembly. The movable contactor assembly achieves the combined operation of transition and switching at one time through the rotation of the insulated central shaft. Limited by its structure, the combined on-load tap switch is useful only for relatively low voltages and small capacity on-load tapping, and not suitable for use in high voltages and large currents.

Additionally, the combined on-load tap switch available in the market, such as the type M switch produced by the MR Company in Germany, is used for changing the transforming ratio while an oiled transformer is loaded. The type M switch includes a switching means and a tap selector to form a single-post structure. However, as the type M switch only has a Y-type connection mode, a large Δ connection transformer would need three type M switches, each of which respectively controls one phase of the transformer, thereby increasing the volume of the transformer, as well as wiring difficulty and cost.

SUMMARY OF THE INVENTION

In order to overcome the technical problems of the prior art on-load tap switch, the present invention provides an external hanging combined vacuum on-load tap switch.

The technical scheme of the invention is that the external hanging combined vacuum on-load tap switch comprises a case (or housing), a tap selector, a switching means assembly, a transmission device, and an electric operation mechanism, wherein: one lateral side end wall of the case is provided with a connecting terminal, which is connected with the coil tap of a transformer; the external side of the end wall is provided with a first flange plate which is connected with a second flange plate of the transformer; the tap selector and the switching means assembly are arranged inside the case in parallel; and the electric operation mechanism is connected with the transmission device and drives the tap selector and the switching means assembly to achieve tapping and switching through the transmission device.

In one embodiment, the tap selector and the switching means assembly are arranged vertically (or up and down) inside the case.

In certain embodiments, the transmission device is arranged inside the case; the power input end of the transmission device is connected with the electric operation mechanism positioned outside the case.

In certain embodiments, the transmission device comprises a combined Geneva/grooved wheel mechanism driving the tap selector to achieve tapping; a straight-line quick moving mechanism driving the switching means assembly to achieve switching; and a mechanical transmission mechanism connecting the tap selector with the switching means; the power output end of the mechanical transmission mechanism is connected with the straight-line quick moving mechanism; and the switching means assembly is linked with the tap selector in a certain phase relation through the straight-line quick moving mechanism.

In certain embodiments, the switching means assembly comprises a switch rack having a soleplate, a straight-line guide rail arranged at the two ends of the soleplate, sliding blocks arranged on the straight-line guide rail in a sliding mode, a movable contactor bracket with two ends fixed on the two sliding blocks, a plurality of movable contactors arranged on the movable contactor bracket and a plurality of sets of vacuum pipe contactor assemblies arranged on the soleplate, wherein, one end of the movable contactor bracket is connected with the straight-line quick moving mechanism and is driven by the straight-line quick moving mechanism to achieve a straight-line movement.

In certain embodiments, the vacuum pipe contactor assembly comprises a driving touch-block fixed on the lateral beam of the movable contactor bracket, an U-shaped bracket fixed on the soleplate, an L-shaped level swing arm arranged on the U-shaped bracket, a touch-wheel arranged at one end of the L-shaped level swing arm; and a vacuum pipe transition contactor arranged at one end of the L-shaped level swing arm.

In certain embodiments, there is provided a worm gear box arranged outside the case and a grade gear clock indicting device arranged inside the worm gear box. The power input end of the worm gear box is connected with the electric operation mechanism for receiving power; and the power output end of the worm gear box is connected with the transmission device.

In certain embodiments, the tap selector takes a cage-shaped structure; the static contactor of the tap selector is arranged on the arc plates surrounding the cage-shaped structure, while the movable contactor of the tap selector is arranged on a rotary insulated center shaft; the combined Geneva wheel (grooved wheel) of the transmission device is arranged at one end of the tap selector; the combined Geneva wheel drives the movable contactor of the tap selector to select different static contactors of the tap selector to achieve the selection operation.

In certain embodiments, the connecting terminals are arranged according to the Δ connection mode. In some cases, the combined vacuum on-load tap switch can be adapted to not only a Y-type connection mode, but also a Δ connection mode.

As the invention adopts the technical scheme mentioned above, compared with the prior art, the invention has the following advantages:

(1) The tap selector and the switching means are arranged in parallel, which greatly increases the transverse insulation distance between each phase position of the switching means, and thereby making the switching means suitable for use in high voltages and large currents. In addition, the external hanging on-load tap switch can be adapted to the Δ connection mode of a transformer. Thus, only one external hanging on-load tap switch is needed to achieve the function of the Δ connection of a transformer instead of three traditional single-phase on-load tap switches.

(2) The combined vacuum on-load tap switch is hung outside the transformer, thereby reducing the volume of the transformer, simplifying the wiring of the winding and reducing the cost, as well as being convenient for the maintenance of the switching means, in particular because the transformer need not be discharged with oil and covered in suspension.

(3) Replacing the arc contactor in the switch with a vacuum pipe increases the breaking capacity of the switching means, prevents the electric arc from polluting the oil contained in the switch and prolongs the maintenance period.

(4) The oil chamber of the switch and the oil tank of the transformer are independent and separated from each other, and in the event that the switch malfunctions, the oil of the transformer will not be contaminated.

BRIEF DESCRIPTIONS OF THE DRAWINGS

The invention and specific embodiments are further illustrated in detail by the attached drawings.

Figure 6:
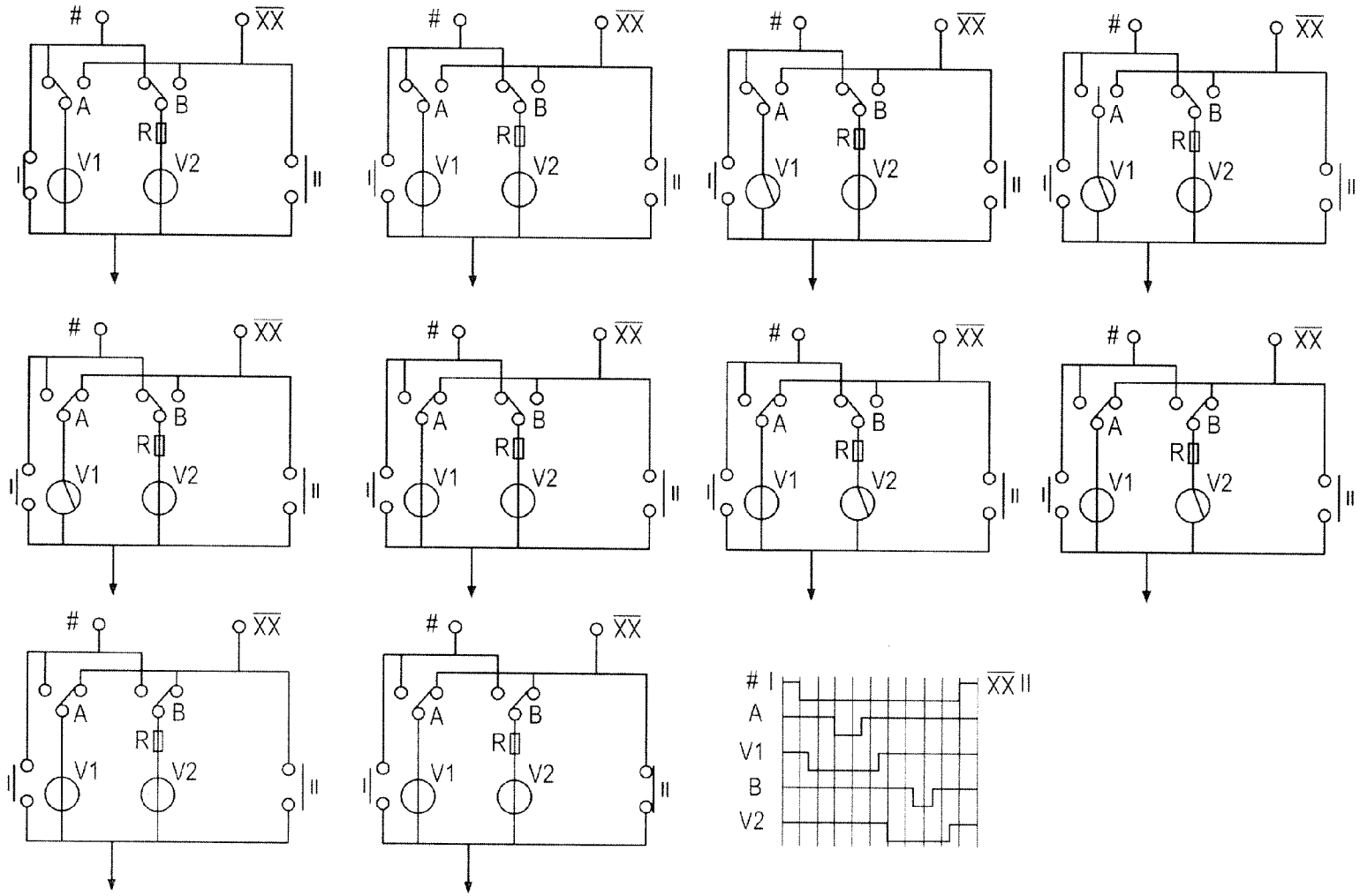

FIG. 6 is a schematic view showing the working principle of the switching means of an external hanging combined vacuum on-load tap switch according to the present invention. In FIG. 6, I refers to a single-side main contactor; II refers to a dual-side main contactor; $V_1$ refers to a main on-off contactor (vacuum pipe); $V_2$ refers to a transition contactor (vacuum pipe); A and B refer to transition contactors; and R refers to a resistor.

Figure 7:
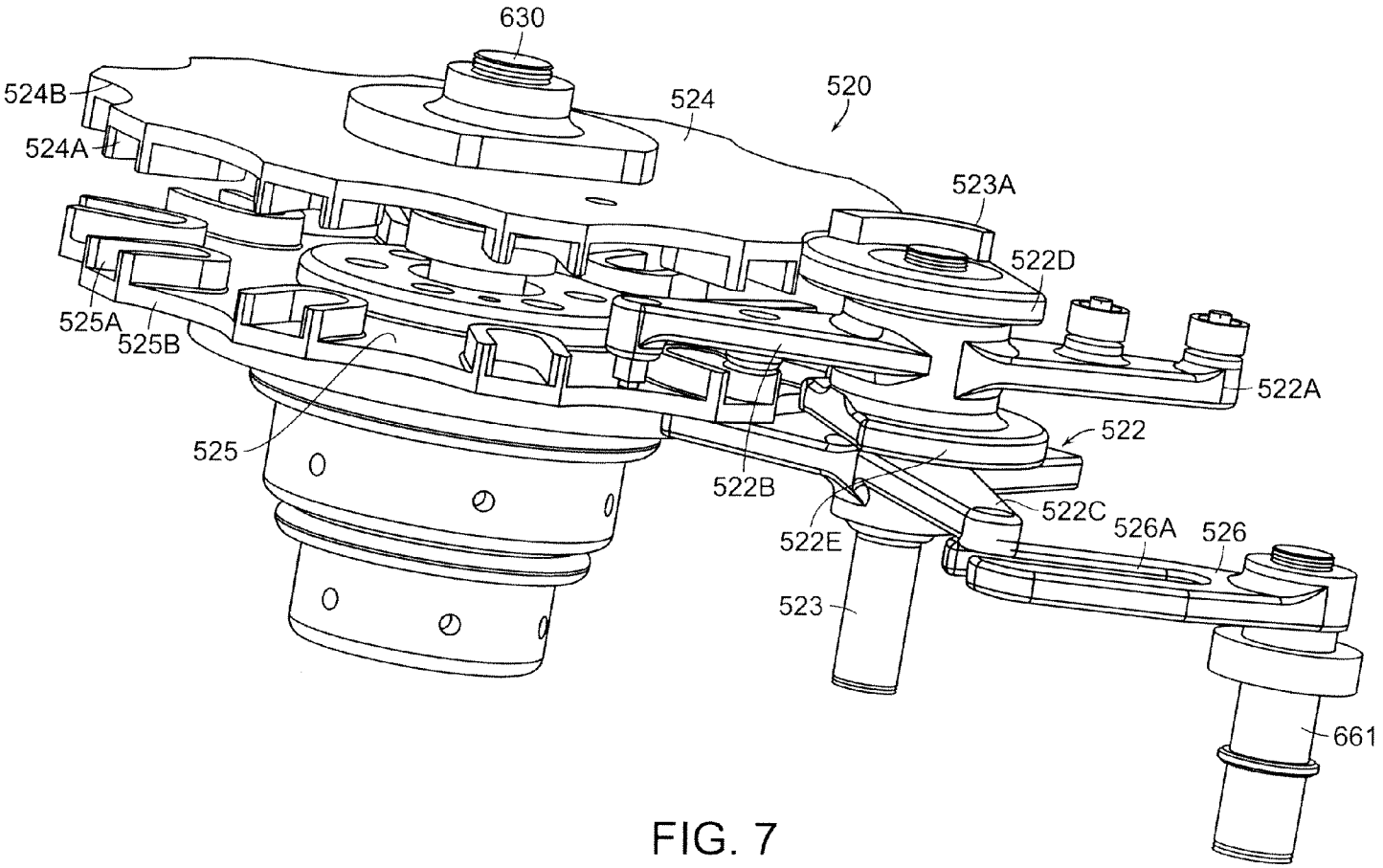

FIG. 7 is perspective schematic view of a combined Geneva mechanism according to the present invention.

Figure 8:
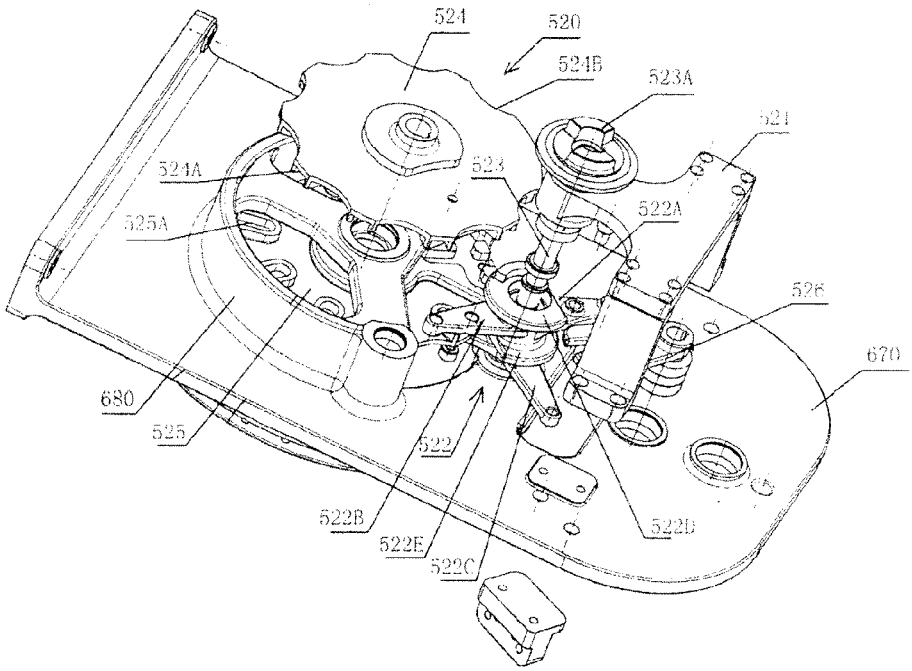

FIG. 8 is an exploded perspective schematic view of a combined Geneva mechanism according to the present invention.

Figure 9:
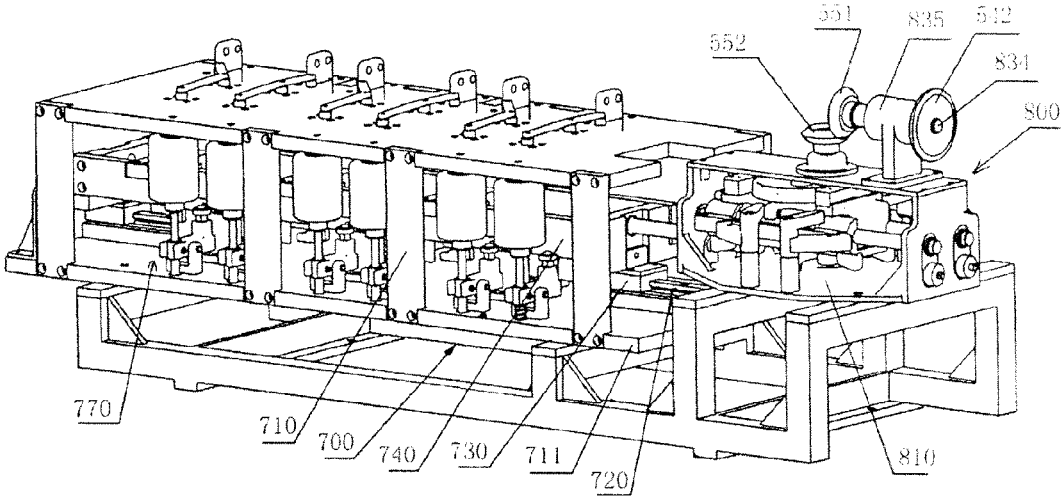

FIG. 9 is a schematic view of a straight-line quick moving mechanism and a switching means assembly according to the present invention.

Figure 10:
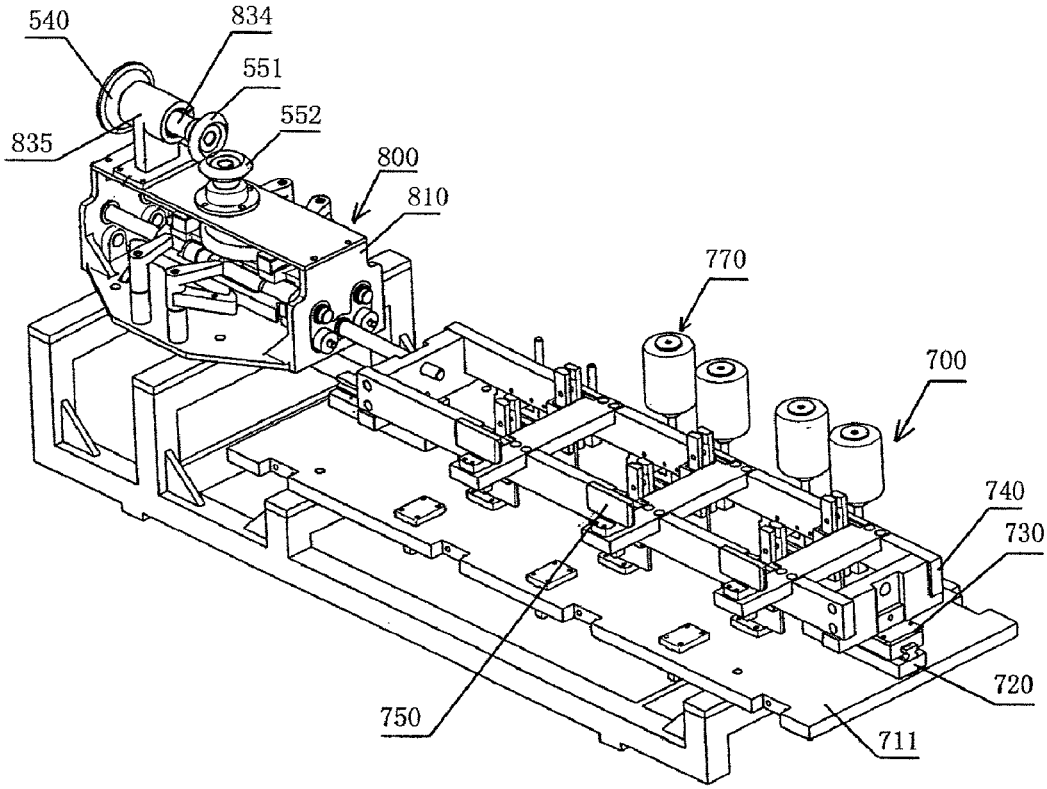

FIG. 10 is schematic view showing the connection between the movable contactor bracket of a movable mounting contactor and a straight-line quick moving mechanism according to the present invention.

Figure 11:
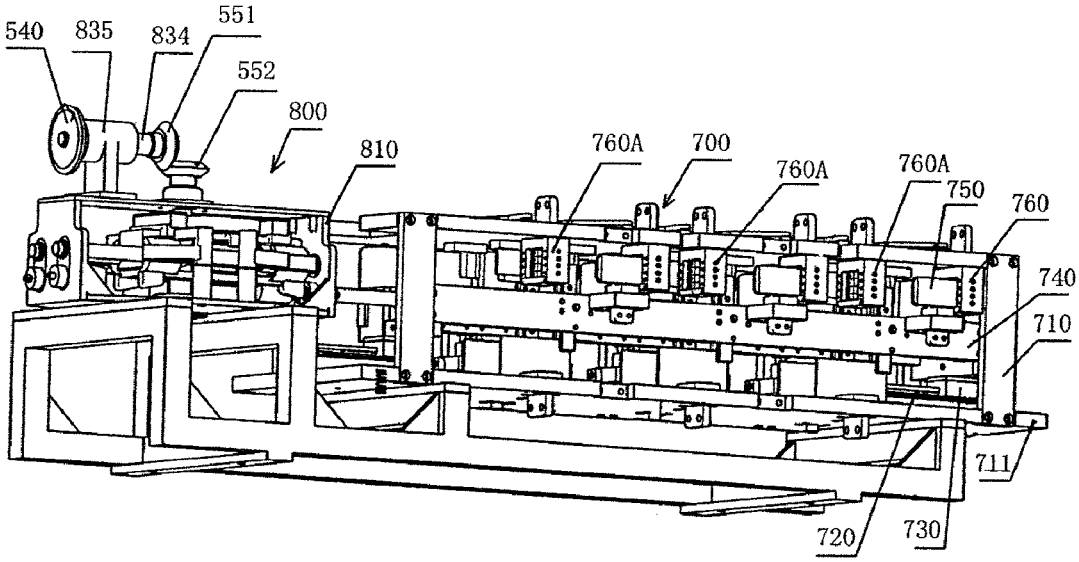

FIG. 11 is schematic view showing the combination of a movable contactor and the static contactor of a switching means assembly according to the present invention.

Figure 12:
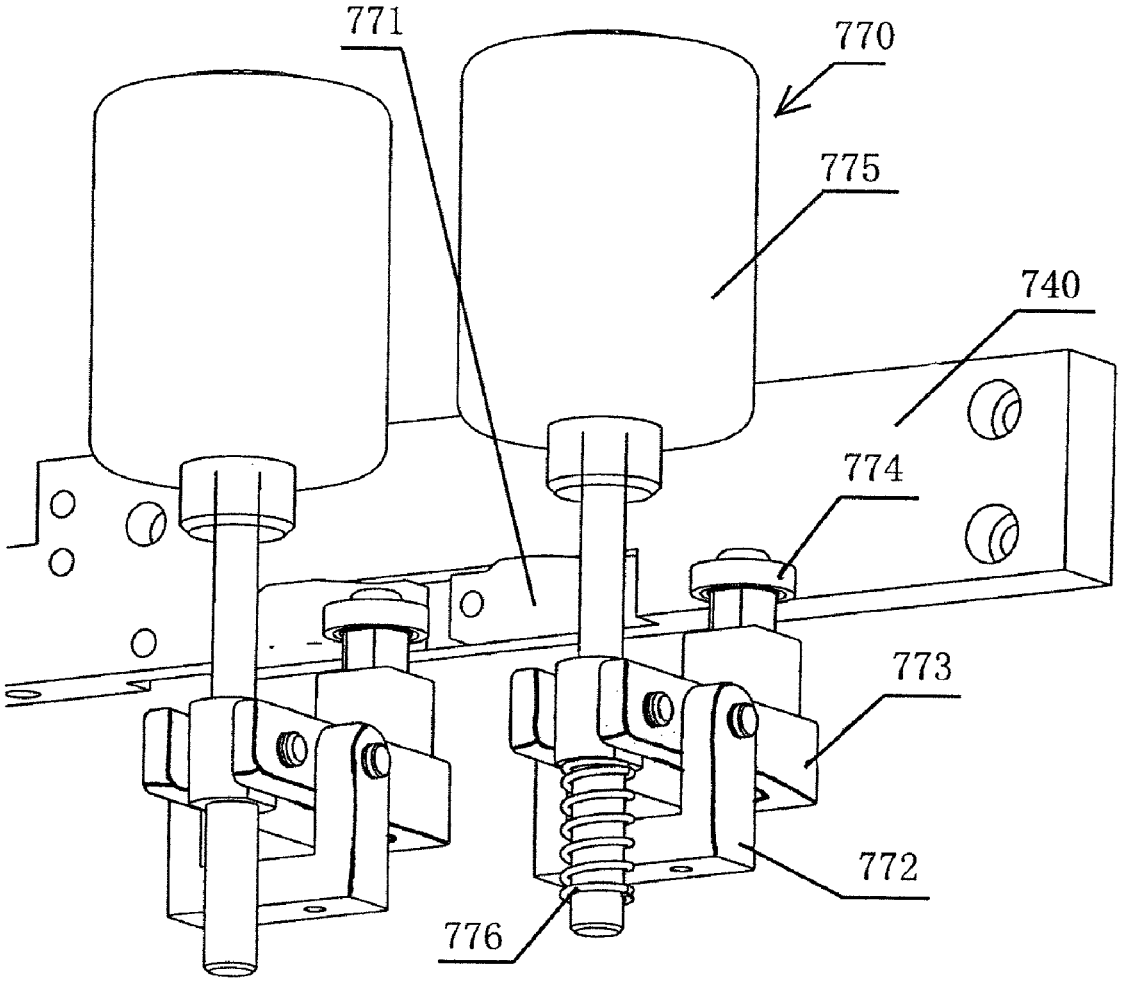

FIG. 12 is a schematic view of a vacuum pipe contactor assembly according to the present invention.

Figure 13:
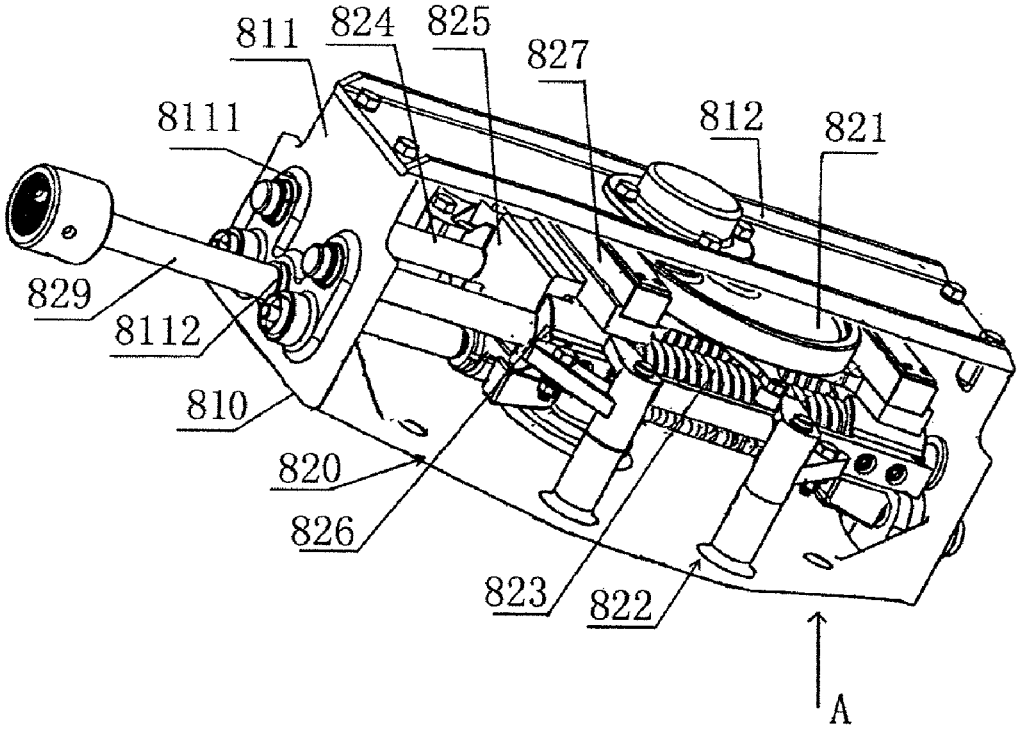

FIG. 13 is a schematic view of a straight-line quick moving mechanism according to the present invention.

Figure 14:
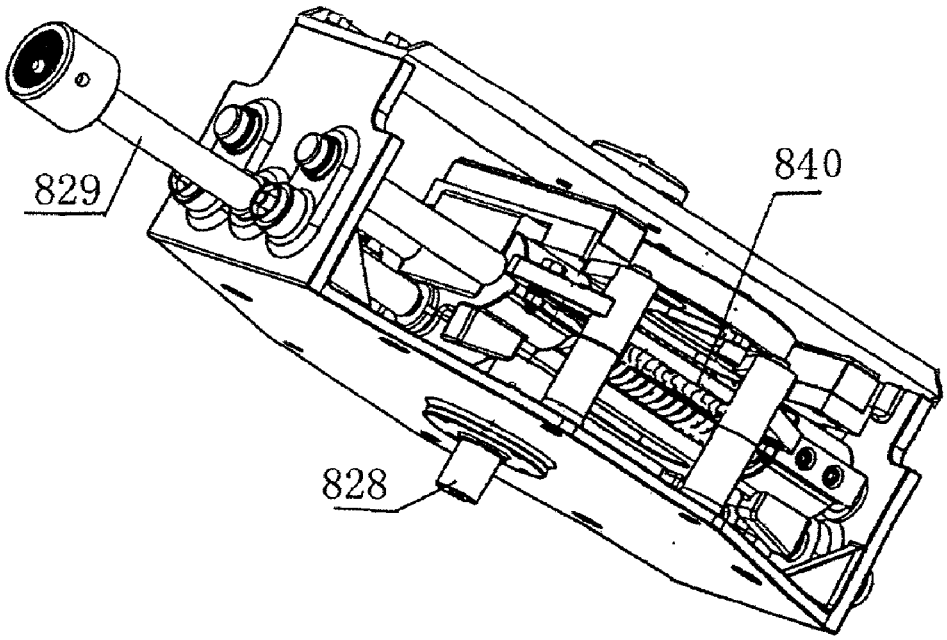

FIG. 14 is alternative view of FIG. 13 in A-direction.

Figure 15:
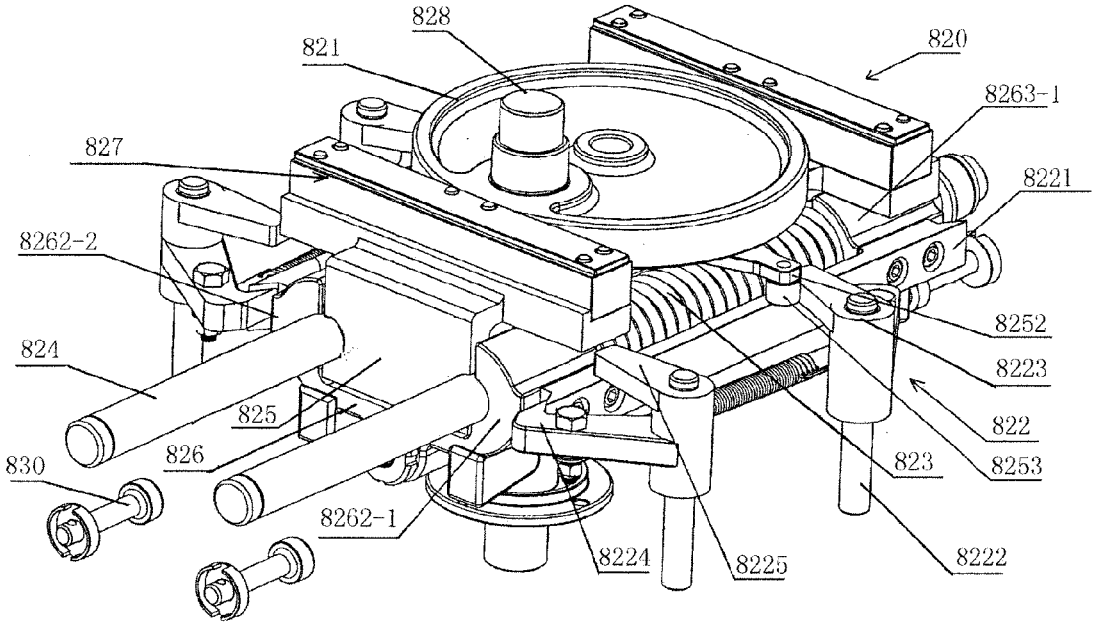

FIG. 15 is a schematic view showing the machine core of a straight-line quick moving mechanism according to the present invention.

Figure 16:
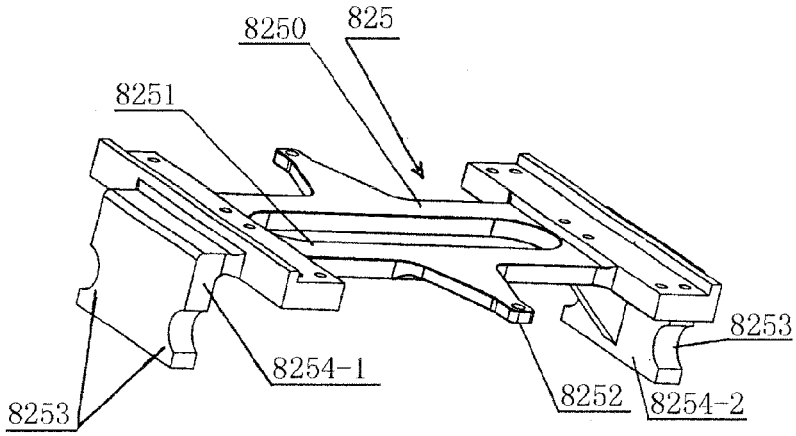

FIG. 16 is a schematic view of the movable sliding seat of a straight-line quick moving mechanism according to the present invention.

Figure 17:
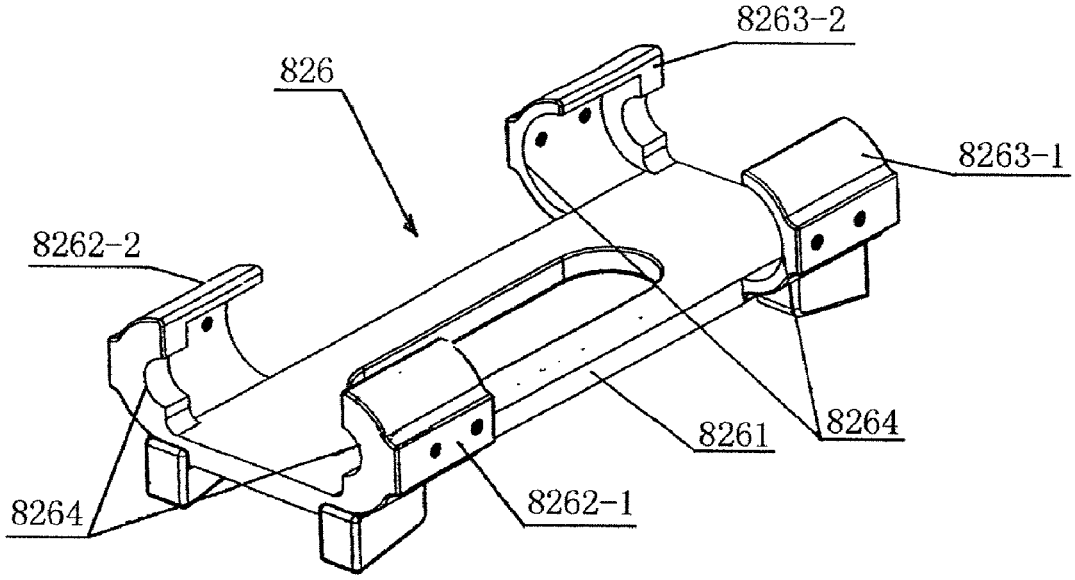

FIG. 17 is a schematic view showing the passive sliding seat of a straight-line quick moving mechanism according to the present invention.

Figure 18:
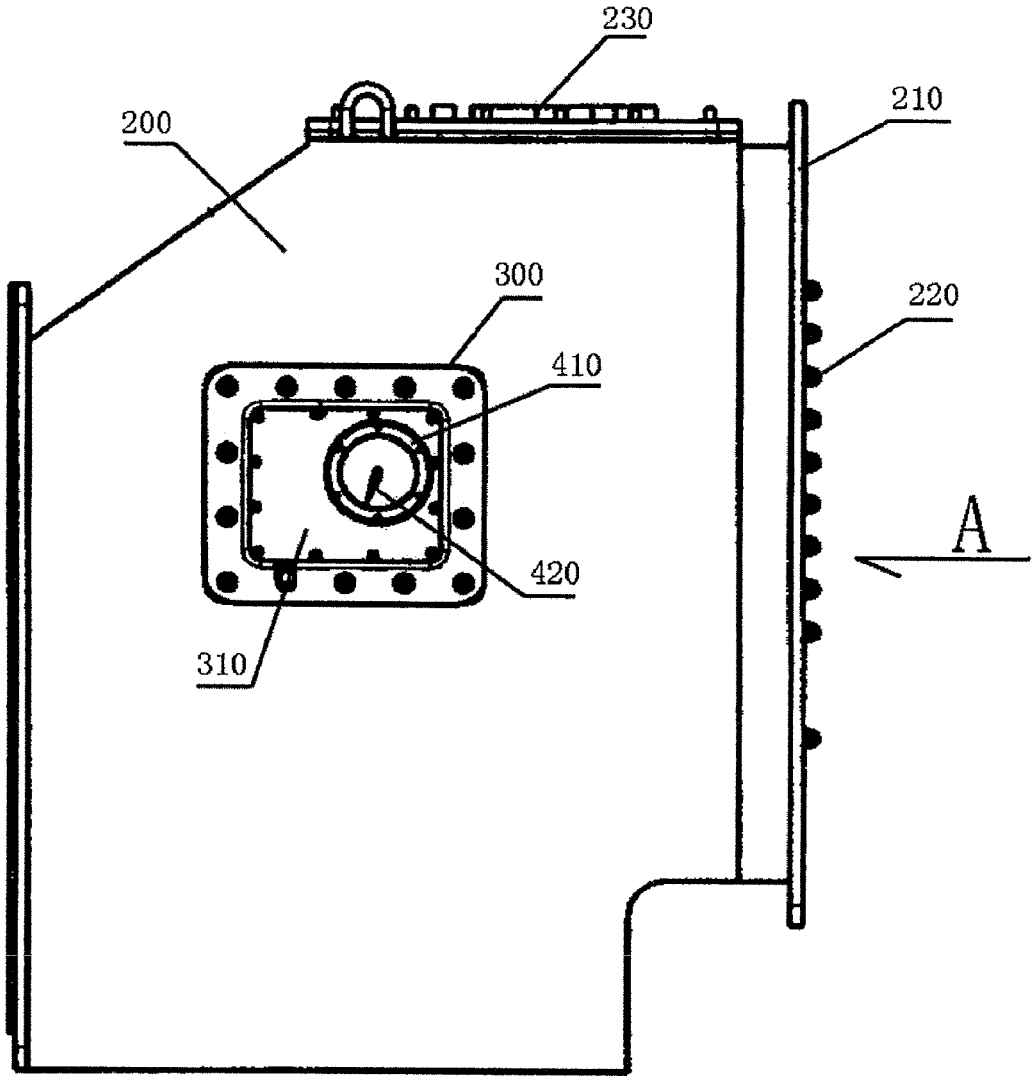

FIG. 18 is a schematic view showing the external structure of an external hanging combined vacuum on-load tap switch according to the present invention.

Figure 19:
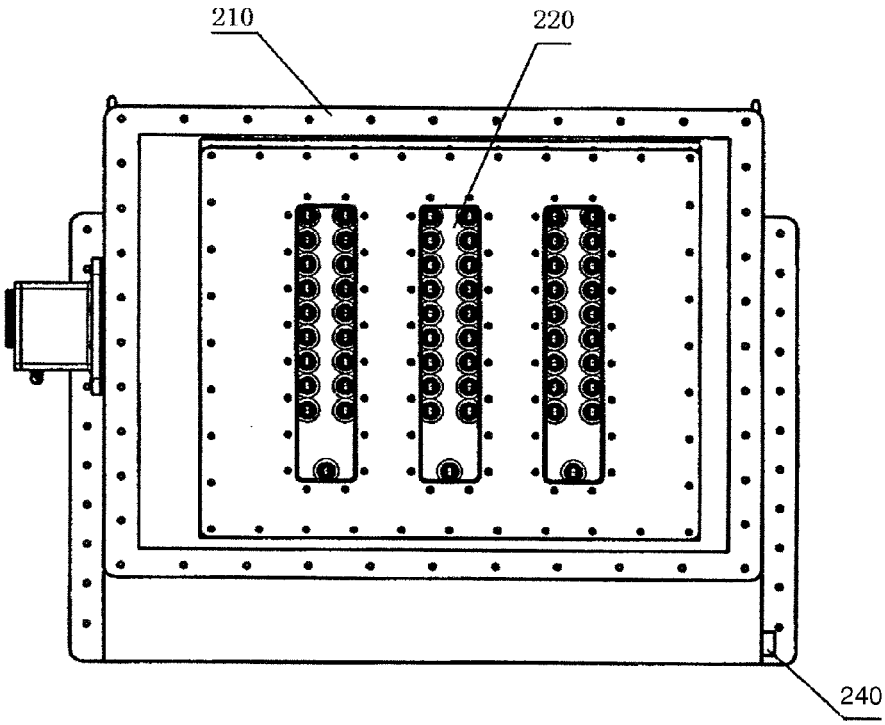

FIG. 19 is an alternative view of FIG. 18 in A-direction.

DETAILED DESCRIPTION

Figure 1:
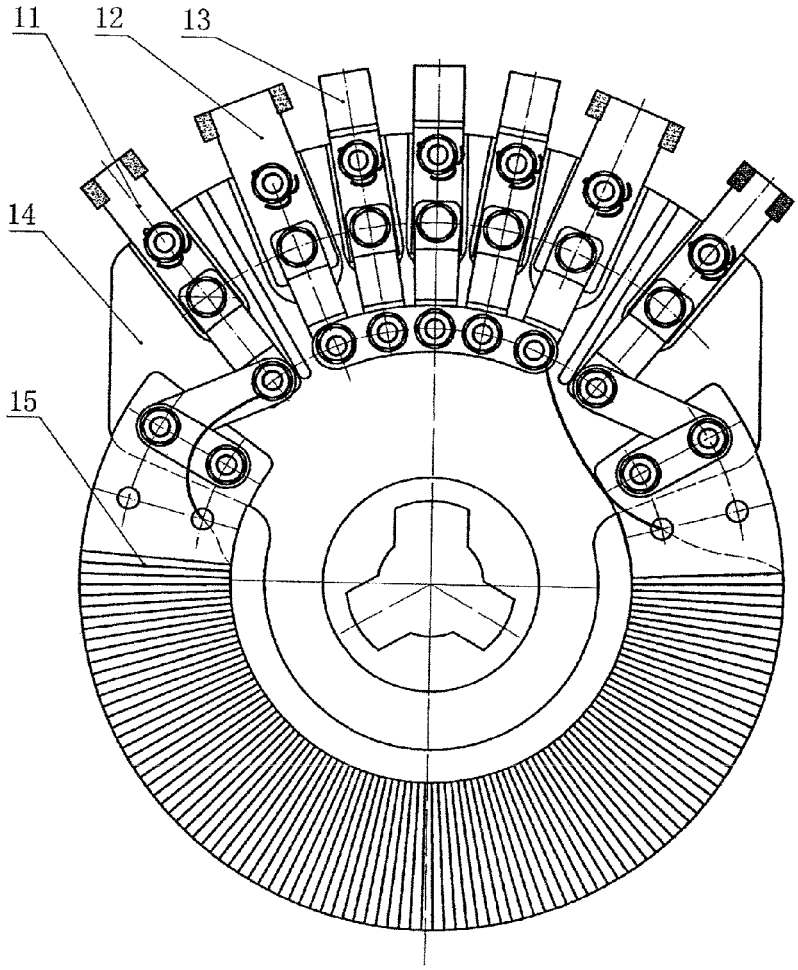
FIG. 1 is a schematic view of a prior art combined movable contactor.
Figure 2:
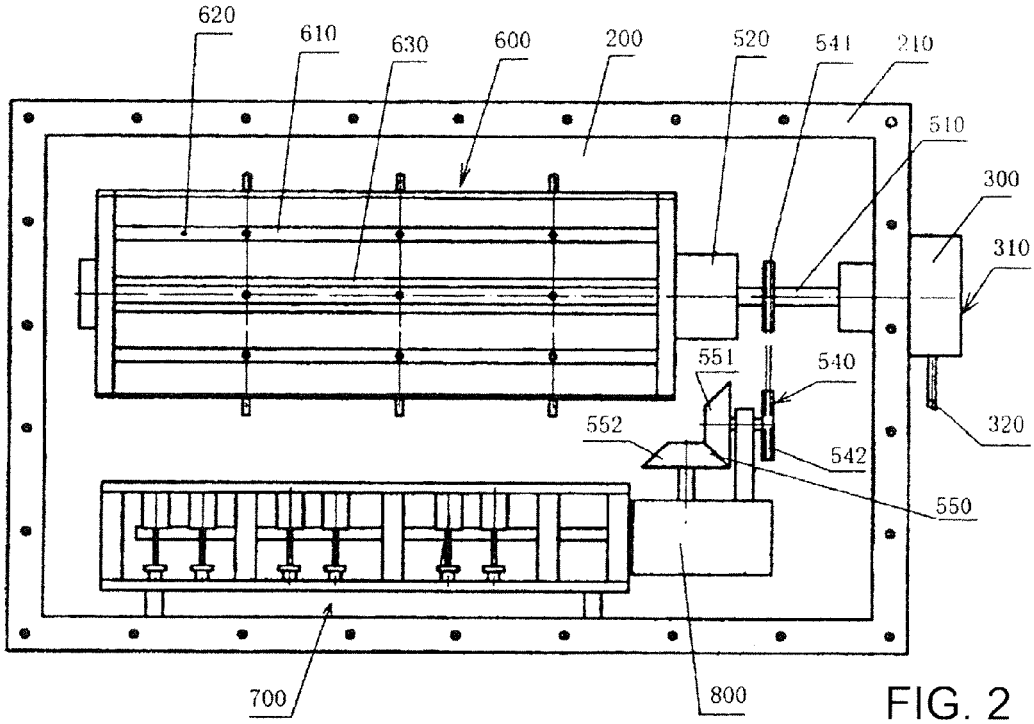
FIG. 2 is a schematic view showing the internal structure drawing of an external hanging combined vacuum on-load tap switch according to the present invention.

As shown in FIG. 2, the external hanging combined vacuum on-load tap switch comprises a case 200. A flange plate 210 is arranged at one side of the case 200. The flange plate 210 is used for butt-connecting with a flange (not shown) arranged on a transformer. The case is hung outside the oil tank of the transformer to form an external hanging tap switch.

A worm gear box 300 is arranged at the other side wall of the case 200, and the worm gear box 300 comprises a worm gear box body welded on one side of the case 200 and a transparent worm gear box cover 310 fixed on the worm gear box through a plurality of fastening bolts.

Figure 3:
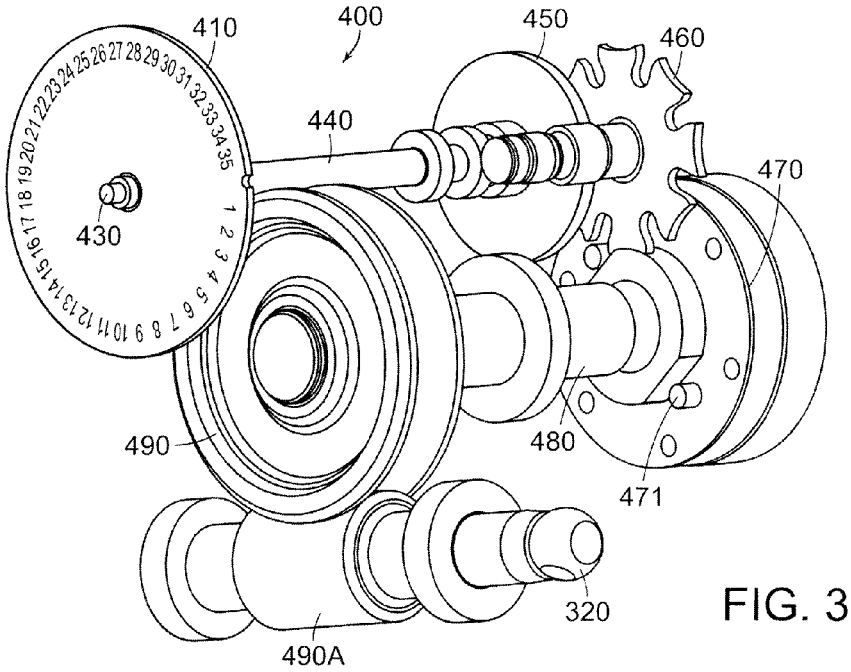
FIG. 3 is a perspective schematic view showing the structure of a grade level clock indicating device in one direction according to the present invention.
Figure 4:
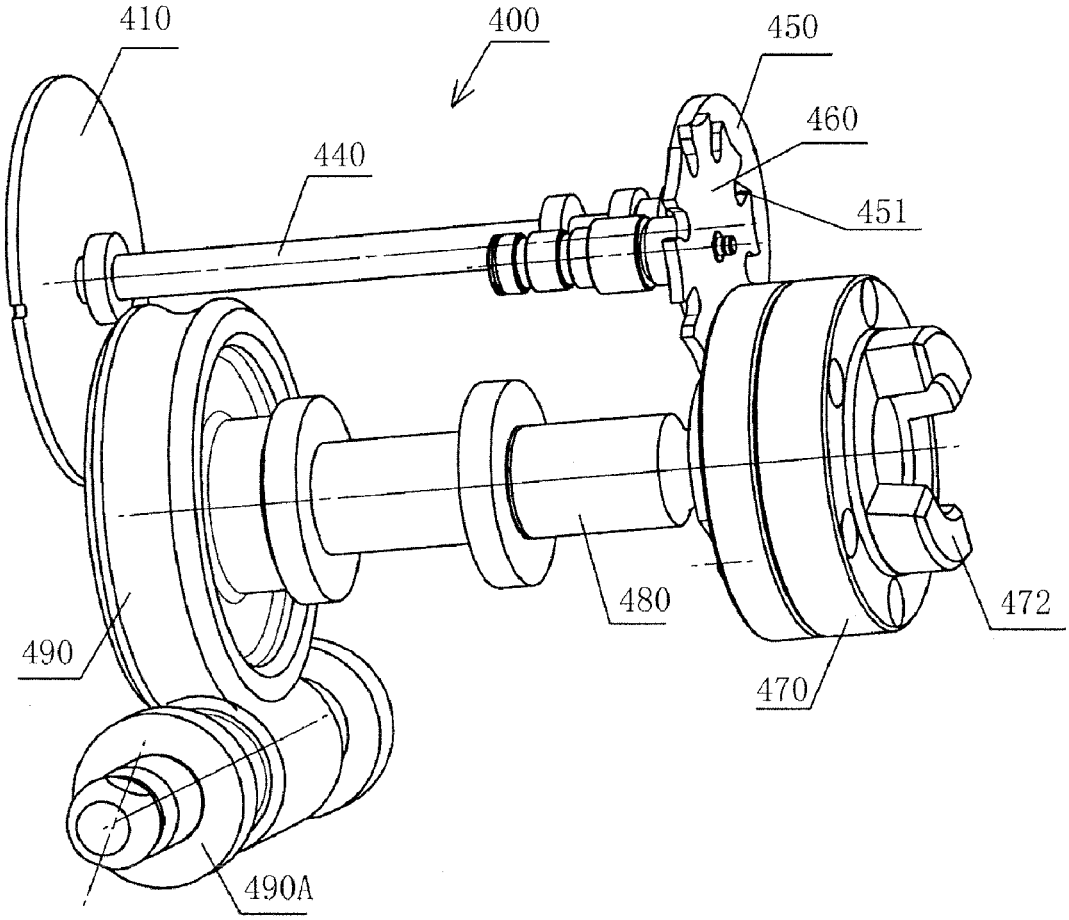
FIG. 4 is a perspective schematic view showing the structure of a grade level clock indicating device in another direction according to the present invention.

As shown in FIG. 3 and FIG. 4, a grade level clock indicating device 400 is arranged inside the worm gear box. The grade level clock indicating device 400 comprises a clock indicating plate 410, a clock finger, a clock finger rotating shaft 430, a rotating shaft sleeve 440, a driven plate 450, a Geneva wheel 460, a driving plate 470, a driving plate shaft 480, a worm gear 490 and a worm pole 490A, wherein, the key on the worm pole 490A is arranged on the power input shaft 320 of the worm gear box 300 (referring to FIG. 2); and the power input shaft 320 is connected with the electric operation mechanism (not shown) so as to achieve the power input. The key on the worm gear 490 is arranged at one end of the driving plate shaft 480, the driving plate 470 is arranged at the other end of the driving plate shaft 480, and the worm gear 490 is driven by the worm pole 490A to rotate, while the driving plate 470 rotates with the worm gear 490 synchronously.

The internal side of the driving plate 470 is provided with a column driving pin 471, while the external side of the driving plate is provided with a convex coupling block 472. The driving plate 470 drives the Geneva wheel 460 to rotate through the column driving pin 471, and at the same time also drives the combined Geneva mechanism 520 through the convex coupling block 472.

The shaft of the Geneva wheel 460 is axially arranged inside the worm gear box 300, and the rotating shaft sleeve 440 is also arranged by a shaft inside the worm gear box 300. The clock indicating rotating shaft 430 passes through the rotating shaft sleeve 440. The clock finger indicating plate 410 is fixedly arranged at one end of the rotating shaft sleeve 440 positioned on the transparent worm gear box cover 310, such that one may observe the change of the clock finger 420 on the clock finger indicating plate 410 from the transparent worm gear box cover 310 (refer to FIG. 18).

The driven plate 450 is fixedly arranged by a key at one end of the clock indicating rotating shaft 430, while the clock finger is fixed at the other end of the clock indicating rotating shaft 430, so that the driven plate 450 can drive the clock finger 420 through the clock indicating rotating shaft 430 to rotate synchronously on the clock finger indicating plate 410, thereby reflecting the position of the tap switch (refer to FIG. 18).

The external side of the driven plate 450 is provided with a column driven pin which can be engaged with the Geneva wheel 460, and the Geneva wheel 460 drives the driven plate 450 to rotate intermittently through the column driven pin.

As shown in FIG. 2, a tap selector 600 and a switching means assembly 700 are arranged inside the case 200 horizontally, and the tap selector 600 and the switching means assembly 700 are parallel to each other, and the tap selector 600 is above the switching means assembly 700.

Figure 5:
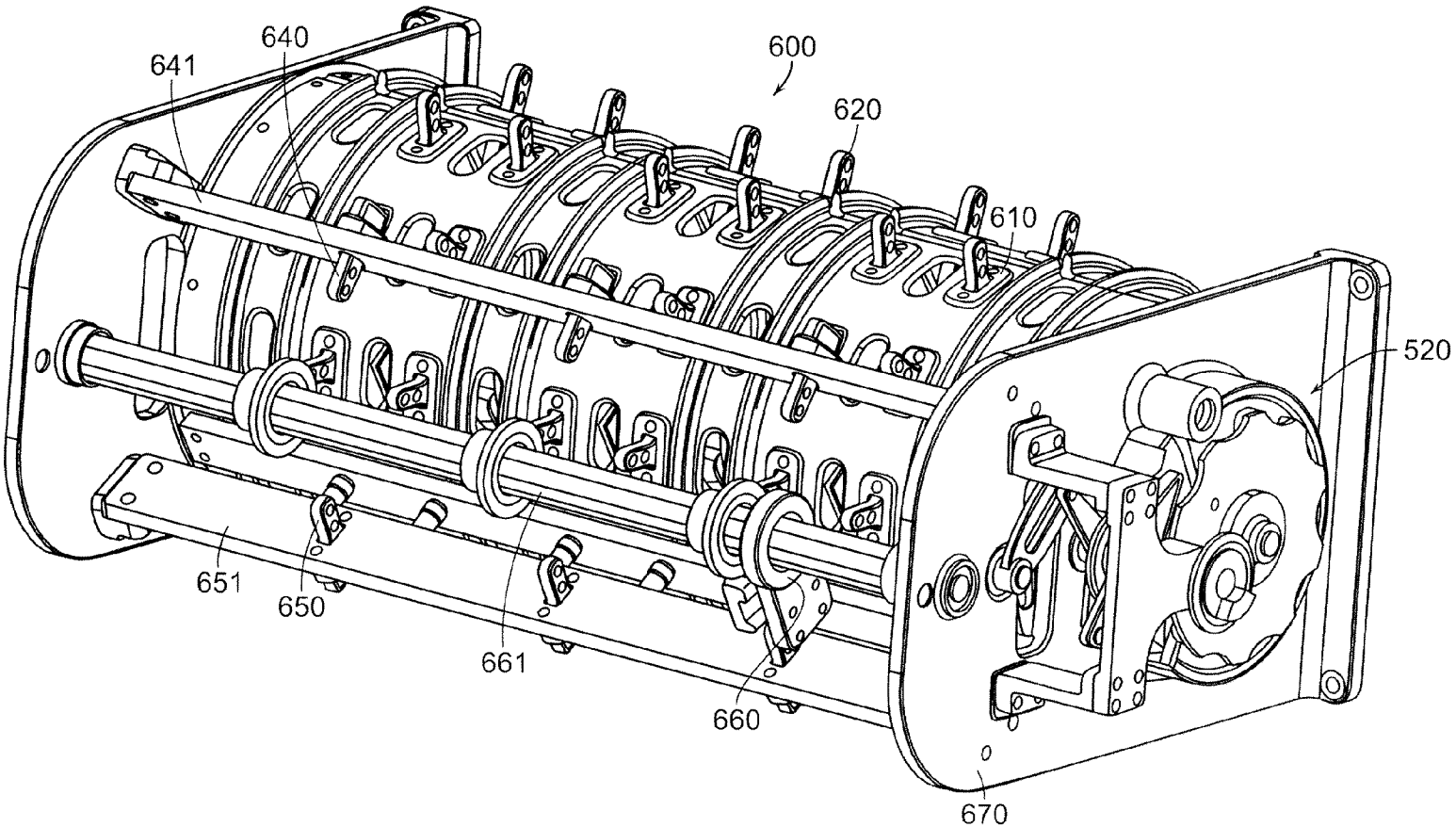
FIG. 5 is a perspective schematic view showing the structure of a tap selector according to the present invention.

As shown in FIG. 2 and FIG. 5, the tap selector 600 takes a cage-shaped structure, a static contactor 620 is arranged on an arc-type plate 610 arranged surrounding the cage-shaped structure, and the movable contactor is arranged on a rotary insulation center shaft 630 (referring to FIG. 2).

As shown in FIG. 5, the tap selector 600 is also provided with single side main contactors 640, dual-side main contactors 650 and main on-off contactors 660, wherein, the single-side main contactors 640 are three-phase contactors, arranged evenly on an arc-type plate 641; and the dual-side main contactors 650 are also three-phase contactors, arranged evenly on an arc-type plate 651. The two ends of the arc-type plate 641 and the arc-type plate 651 are fixed on the two end plates 670 of the tap selector 600. The main on-off contactors 660 are three-phase contactors, arranged evenly on the rotating shafts 661 of the main on-off contactors to rotate synchronously with the rotating shafts 661 of the main on-off contactors, contacted respectively with the single-side main contactors 640 or the dual-side main contactors 650. The two ends of the rotating shafts 661 of the main on-off contactors are arranged on the two end plates 670 of the tap selector 600 through a bearing. The single-side main contactors 640 and the dual-side main contactors 650 are respectively connected with one set of corresponding static contactors 620 so as to achieve switching as shown in FIG. 6. The tap state of the tap selector 600 may increase by one fold compared to its primary state through the single-side main contactors 640 and the dual-side main contactors 650.

As shown in FIG. 2 and FIG. 5, the combined Geneva mechanism 520 of the transmission device is arranged at the end of the tap selector 600.

As shown in FIG. 7 and FIG. 8, the combined Geneva mechanism 520 comprises a drive-groove element mounting bracket 521, a combined drive-groove element 522, a mounting shaft of the combined drive-groove element 523, a first Geneva wheel 524, a second Geneva wheel 525 and a third Geneva wheel 526. The drive-groove element mounting bracket 521 is arranged on the end plate 670 positioned at one side of the tap selector 600 through fastening elements; the two ends of the combined drive-groove element mounting shaft 523 are arranged on the drive-groove element mounting bracket 521 and on the end plate 670 through a bearing seat. The key on the combined drive-groove element 522 is arranged on the combined drive-groove element mounting shaft 523, rotating along with the combined drive-groove element mounting shaft 523. One end of the combined drive-groove element mounting shaft 523 is also provided with a convex coupling block 523A, in which the convex coupling block 523A is connected with the convex coupling block (not shown) positioned at one end of the transmission shaft 510 (shown in FIG. 2); the convex coupling block positioned at the other end of the transmission shaft 510 is engaged with the convex coupling block 472 (shown in FIG. 4) positioned at the driving plate 470 (shown in FIG. 4) for receiving the power of the convex coupling block so as to drive the combined drive-groove element 522 to rotate synchronously through the combined drive-groove element mounting shaft 523.

The combined drive-groove element 522 comprises a first drive-groove element 522A which drives the first Geneva wheel 524 to rotate intermittently, a second drive-groove element 522B which drives the second Geneva wheel 525, a third drive-groove element 522C which drives the third Geneva wheel 526, a first external locking arc 522D which locks the first Geneva wheel 524, a second external locking arc 522E which locks the second Geneva wheel 525, wherein, the first drive-groove element 522A, the second drive-groove element 522B, the third drive-groove element 522C, the first external locking arc 522D and the second external locking arc 522E are co-axially arranged on the combined drive-groove element 522, and their rotating centers are the same.

The insulated center shaft 630 of the tap selector 600 is supported by the end plate 670 through a bearing seat 680, wherein the bearing seat 680 is fixedly arranged on the end plate 670 via fastening bolts. The key on the first Geneva wheel 524 and the key on the second Geneva wheel 525 are co-axially arranged on the insulated center shaft 630, and the insulated center shaft 630 can be driven to rotate by turning the first Geneva wheel 524 and the second Geneva wheel 525.

The first Geneva wheel 524 and the second Geneva wheel 525 are respectively provided with a plurality of drive-grooves 524A and 525A, and the drive-grooves 524A and 525A of the first Geneva wheel 524 and the second Geneva wheel 525 are opposite to each other, with one upwards and the other downwards. On the first Geneva wheel 524 and the second Geneva wheel 525, a first internal locking arc 524B is arranged between the two drive-grooves 524A, while a second internal locking arc 525B is arranged between the two drive-grooves 525A.

The third Geneva wheel 526 is only provided with one drive-groove 526A, and the third Geneva wheel 526 is fixedly arranged on the rotating shaft 661 of the main on-off contactor so as to drive the rotating shaft 661 of the main on-off contactor to rotate.

When the combined drive-groove element 522 rotates, the first drive-groove element 522A and the second drive-groove element 522B respectively drive the first Geneva wheel 524 and the second Geneva wheel 525 to rotate in a mode of increasing grade. When the first drive-groove element 522A drives the first Geneva wheel 524 to rotate, the second external locking arc 522E and the second internal locking arc 525B are engaged with each other so as to lock the second Geneva wheel 525. When the second drive-groove element 522B drives the second Geneva wheel 525 to rotate, the first external locking arc 522D and the first internal locking arc 525B are engaged with each other so as to lock the first Geneva wheel 525; while the third drive-groove element 522C drives the rotating shaft 661 of the main on-off contactor to rotate after the third Geneva wheel 526 is driven to rotate for one gear, thereby driving the main on-off rotating shaft 661 and achieving the desired switching with the single-side main contactor 640, or the dual-side main contactor 650, as the main on-off contactor 660 rotates synchronously with the main on-off rotating shaft 661.

As shown in FIG. 2, FIG. 9 and FIG. 11, a straight-line quick moving mechanism 800 of the transmission device is arranged at the end of the switching means assembly 700. The mechanical transmission mechanism of the transmission device comprises a chain wheel mechanism 540 and a bevel gear mechanism 550. The driving chain wheel 541 of the chain wheel mechanism 540 is arranged on the transmission shaft 510 by a key. A driven chain wheel 542 is arranged axially with the driving bevel gear 551 of the bevel gear mechanism 550 so as to drive the driving bevel gear 551 to rotate synchronously. On one hand, a driven bevel gear 552 is engaged with the driving bevel gear 551 to rotate after receiving the power of the driving bevel gear, and on the other hand, connected with the power input end of the straight-line quick moving mechanism 800.

As shown in FIG. 9, FIG. 10 and FIG. 11, the switching means assembly 700 comprises a switch rack 710 having a soleplate 711, a straight-line guide rail 720 arranged at the two ends of the soleplate 711, sliding blocks 730 arranged on the straight-line guide rail 720 in a sliding mode, a movable contactor bracket 740 with two ends fixed on the two sliding blocks 730, and three-phase movable contactors 750 arranged on the movable contactor bracket 740, three-phase static contactors 760 and three-phase fixed contactors 760A arranged on the switch rack 710, and a three-phase vacuum pipe contactor assembly 770 arranged on the soleplate 711, wherein, the three-phase static contactors 760 and the three-phase fixed contactors 760A are arrayed alternately; one end of the movable contactor bracket 740 is connected with the straight-line quick moving mechanism 800 and is driven by the straight-line quick moving mechanism 800 to achieve a straight-line movement.

As shown in FIG. 12, each phase of vacuum pipe contactor assembly 770 comprises a driving touch-block 771, a U-shaped bracket 772, a L-shaped level swing arm 773, a touch-wheel 774, a vacuum pipe transition contactor 775, and a reset spring 776, wherein, the driving touch-block 771 is fixed on the lateral beam of the movable contactor bracket 740; the U-shaped bracket 772 is fixed on the soleplate 711 (shown in FIG. 11); the L-shaped level swing arm 773 is arranged on the U-shaped bracket 772; the touch-wheel 774 is arranged at one end of the L-shaped level swing arm 773; the vacuum pipe transition contactor 775 is arranged by a hinge at the other end of the L-shaped level swing arm 773; and the reset spring 776 is arranged on the vacuum pipe transition contactor 775.

As shown in FIG. 13, the straight-line quick moving mechanism 800 (shown in FIG. 11) of the invention comprises a base seat 810, a machine core 820 arranged inside the base seat 810, and a driving mechanism driving the machine core 820 to operate.

As shown in FIG. 9, FIG. 10 and FIG. 11, the driving mechanism comprises a driven chain wheel 542, a driving bevel gear 551, and a driven bevel gear 552. The driven chain wheel 540 and the driving bevel gear 551 are arranged axially at two ends of a driving shaft 834. The driving shaft 834 is arranged on the base seat 810 through a bearing housing 835. The driven chain wheel 542 is driven by an external force to drive the driving bevel gear 551 through the driving shaft 834 to rotate. The driving bevel gear 551 and the driven bevel gear 552 form a bevel gear pair, and the driving bevel gear 551 drives the driven bevel gear 552 to rotate, while the driven bevel gear 552 is connected with an input shaft to drive an eccentric wheel to rotate.

As shown in FIG. 13 through FIG. 17, the machine core 820 (an amplified view of the inner parts of the machine core is shown in FIG. 15) comprises an eccentric wheel 821, a pair of grab component 822, two energy storing springs 823, two guide poles 824, a movable sliding seat 825, a passive sliding seat 826 and two sliding blocks 827.

The base seat 810 adopts a U-shaped steel structure with folding edges 811 arranged at the two ends. A connecting board 812 for reinforcement and support is arranged between the two folding edges 811. The connecting board 812 is provided with a shaft hole. One input shaft 828 is extended from the shaft hole to the outside of the connecting board 812. The input shaft 828 is used as the power source of the whole straight-line quick moving mechanism 700, for example, executing the driven bevel gear 552 of the driving mechanism to act in a certain sequence. Of course, the input shaft 828 may be connected with other executing mechanisms.

The two folding edges 811 are respectively provided with a plurality of mounting holes 8111 for mounting the guide pole 824 and a shaft hole 8112 for feeding an output shaft 829. One end of the output shaft 829 is connected with the passive seat body of the passive sliding seat 826, while the other end is connected with the movable contactor bracket 740.

The passive sliding seat 826 (referring to FIG. 17) comprises a passive seat body 8261. The two ends of the passive seat body 8261 are respectively provided with a pair of opposite, outer guide groove housings 8262-1 and 8262-2, and 8263-1 and 8263-2. The internal sides of the outer guide groove housings 8262-1 and 8262-2, and 8263-1 and 8263-2 are respectively provided with a semicircular outer guide groove opening 8264.

The movable sliding seat 825 (referring to FIG. 16) comprises a movable seat body 8250. The middle of the movable seat body 8250 is provided with a long slotted hole 8251. A stopper 8252 is respectively extended outwards from the two sides of the movable seat body 8250 corresponding to the center of the slotted hole 8251. In one embodiment, the end bottom of the stopper 8252 is connected with a rotating wheel 8253 (referring to FIG. 15). The two ends of the movable seat body 8250 are respectively provided with inner guide groove seats 8254-1 and 8254-2, the two sides of the inner guide groove seats 8254-1 and 8254-2 are provided with a semicircular inner guide notch 8253. The inner guide groove seats 8254-1 and 8254-2 are positioned inside the outer guide groove seats 8262-1 and 8262-2, and 8263-1 and 8263-2 of the passive sliding seat 826. The semicircular inner guide notch 8253 of the inner guide groove seats 8254-1 and 8254-2 is symmetric to and concentric to the semicircular outer guide notch 8264 of the outer guide groove seats 8262-1 and 8262-2, and 8263-1 and 8263-2. The sliding block 827 is respectively arranged above the two ends of the movable seat body 8250 of the movable sliding seat 825.

The two ends of the guide pole 824 are fixedly arranged inside the mounting hole 8111 of the base seat by passing through the semicircular outer guide notch 8264 and the semicircular inner guide notch 8253 of the passive sliding seat 826 and the movable sliding seat 825.

In one embodiment, two energy storing springs 823 are respectively sleeved on their guide pole 824 and positioned on the passive sliding seat 826. One half of the end surface of each energy storing spring 823 is locked between the outer guide groove seats 8262-1 and 8262-2, and between 8263-1 and 8263-2 of the passive sliding seat 826, while the other half is locked between the inner guide groove seats 8254-1 and 8254-2 of the movable sliding seat 825.

Each radius of the outer guide notch 8264 positioned at the internal side of the outer guide groove seats 8262-1 and 8262-2, and 8263-1 and 8263-2 of the passive sliding seat 826, and the inner guide notch 8253 positioned at the external side of the inner guide groove seats 8254-1 and 8254-2 of the two ends of the movable sliding seat 825, is similar to the radius of the guide pole 824. The outer guide groove seats 8262-1 and 8262-2, and 8263-1 and 8263-2 arranged at the two ends of the passive sliding seat 826, and the inner guide groove seats 8254-1 and 8254-2 arranged at the two ends of the movable sliding seat 825 can slide on the guide pole.

As shown in FIG. 15, each claw board 8221 is respectively fixed outside the outer guide groove seats 8262-1 and 8262-2, and 8263-1 and 8263-2 (shown in FIG. 17) positioned at the two sides of the passive sliding seat 826. A hook component 822 comprises two pairs of claw brackets 8222, two pairs of shaft sleeves 8223, two pairs of hooks 8224 and two pairs of rotating arms 8225. The claw bracket 8222 is arranged on the base seat 810 and positioned at the outer side of the claw board 8221. Each shaft sleeve 8223 is sleeved on the top of the corresponding claw bracket 8222. The rotating arms 8225 and one end of the hooks 8224 are fixed on the shaft sleeves 8223, while the other end of the rotating arms 8225 are in contact with the rotating wheel 8253 of the movable sliding seat 825, and driving the shaft sleeve 8223 to rotate with the impact of the rotating wheel 8253. The other end of the hooks 8224 are buckled or released from the end of the claw board 8221 along with the rotation of the shaft sleeves 8223. The ends of the claw boards 8221 have a shape of an inwards concave taper, forming a wedge-like shape. The other end of the hooks 8224 is similar to the concave taper shape of the ends of each claw board 8221, such that a release-capture relation is formed when the hook 8224 is contacted with the claw board 8221.

The eccentric wheel 821 is arranged on the input shaft 828 and positioned between two sliding blocks 827 which are positioned above the movable seat body 8250 of the movable sliding seat 825. The input shaft 828 passes through the long slotted hole 8251 positioned on the movable seat body 8250 of the movable sliding seat 825. The length of the long slotted hole 8251 is larger than the distance that the input shaft 828 moves back and forth one time.

The straight-line quick moving mechanism of the invention also comprises at least two damping devices 830 which are respectively arranged on the two folding edges 811 of the base seat 810. In one embodiment, there are provided four damping devices 830, with two on each of the two folding edges 811 of the base seat 810.

In certain embodiments, there is provided a pair of tension springs 840 which are respectively arranged between the rotating arms 8225 of the hooks 8224.

The operating principle of the invention is as follows: the power from the mechanical transmission mechanism drives the driven chain wheel 552 to rotate; the driving bevel gear 551 is driven by the driving shaft 834 to rotate; the driving bevel gear 551 and the driven bevel gear 552 form a taper gear pair; the driven bevel gear 552 is driven by the driving bevel gear 551 to rotate through gear engagement; the eccentric wheel 821 is driven by the driven bevel gear 552 to rotate through the input shaft 828; the rotation of the eccentric wheel 821 pushes the sliding block 827 and drives the sliding seat 825 to move; as the movement of the sliding seat 825 pushes one end of the energy storing spring 823, and the passive sliding seat 826 stops the claw board 8221 through the hooks 8224 and further stops the end of the energy storing spring 823, the energy storing spring 823 is compressed for storing energy. When the sliding seat 825 moves to rotate the rotating wheel 8253, the impact force of the rotating wheel 8253 moves the hooks 8224 positioned at their corresponding sides away from the claw board 8221 so as to release the passive sliding seat 826; and due to the effect of the energy storing spring 823, the output shaft 829 is driven by the passive sliding seat 826 to move in a straight-line quickly.

The output shaft 829 also drives the movable contactor bracket 740 to move in a straight-line on the straight-line guide rail 720 through the sliding blocks 730. During the straight movement of the movable contactor bracket 740, the driving touch block 710 positioned at the lateral beam touches with the touch wheel 740, so that the L-shaped level swing arm 730 swings around the contact point between the L-shaped level swing arm 730 and the U-shaped bracket 720 through the touch wheel 740. The swing of the L-shaped level swing arm 730 causes the motion of the vacuum pipe transition contactor 750 and also the straight-line movement of the three-phase movable contactors 750. Referring to FIG. 11, the three-phase movable contactors 750 are respectively communicated with the three-phase static contactors 760 so as to achieve switching at the same time.

When movement of the movable contactor bracket 740 is near to end, the damping devices 830 start to work, thereby avoiding a hard collision. After completing the motion, the passive sliding seat 826 is moved to a new locking position; the hooks 8224 stop the claw board 8221 again with the force of the tension spring 840; and the mechanism is locked again and ready for the next cycle.

When the gear of the transformer is changed, the switch power device drives the selector to choose a proper gear. While this motion is repeated, the eccentric wheel 821 rotates continuously to repeat the motion in the reverse; the output shaft 829 moves in a straight-line in the opposite direction; and the output shaft 829 drives the movable contactor bracket 740 to move in a straight-line in the reverse on the straight guide rail 720 through the sliding block 730. While the movable contactor bracket 740 is in a straight-line movement, the three-phase movable contactors 750 move in a straight-line in the reverse and are communicated respectively with the three-phase fixed contactors 760A to complete a cycle.

The two ends of the movable contactor bracket 740 of the invention are fixed on the sliding block 730 of the straight guide rail 720, with the advantages of small friction resistance, reliable movement and long service life.

The operating processes of the transmission device and the switching means are as follows: the power from the electric operation mechanism is inputted into the worm gear box 300 through the power input shaft 320. After deceleration by the worm gear box 300, the power drives both the combined Geneva wheel 520 and the grade-gear clock indicating device 400 at the same time. On one hand, the power drives the combined Geneva wheel 520 through the transmission shaft 510 and further drives the insulation center shaft 630 of the tap selector 600 to rotate, so that the movable contactors select different static contactors 620 for connection so as to choose the gear change of the switch. Meanwhile, the transmission shaft 510 drives the movable contactor bracket 740 through the chain wheel mechanism 540 and the bevel gear mechanism 550 and the straight-line quick moving mechanism 800 to move straightly on the straight guide rail 720 through the sliding block 730. During the straight-line movement of the movable contactor bracket 740, the driving touch block 761 positioned at its lateral beam touches the touch wheel 764 to make the L-shaped level swing arm 763 swing around the movable contactor bracket 740 and the U-shaped bracket 762 through the touch wheel 764. The swing of the L-shaped level swing arm 733 drives the vacuum pipe transition contactor 765 to achieve one voltage adjusting operation. On the other hand, the power drives the clock finger 420 of grade-gear clock indicating device 400 to indicate the grade of the switch on the clock finger indicating plate 410 through the driving plate 470, the column driving pin 471, the Geneva wheel 460, the column driven pin 451, the driven plate 450, and the clock finger rotating shaft 430 of the grade-gear clock indicating device 400 inside the worm gear box 300 (referring to FIG. 2 and FIG. 4).

As shown in FIG. 18, there comprises a case 200, and a first flange plate 210 connected with a second flange plate contained in the transformer. A plurality of bolt holes is arranged on the flange plate 210 for connecting the case 200 with the transformer. The interior of the flange plate 210 is provided with a terminal 220 for connecting the winding tap of the transformer. The case 200 is provided with a case cover 230, which can be provided with an oil conservator, a gas relay, etc. The side wall of the case 200 is provided with a worm gear box 300 whose outer side is provided with a clock finger indicating plate 410, and a clock finger 420.

As shown in FIG. 19 which is an alternative view of FIG. 18 in A-direction, the terminal 220 in a three-phase layout may be adapted to the Δ connection method of the transformer. 240 is a switch oil drain hole.

The above descriptions demonstrate the basic principles, main characteristics and advantages of the present invention. It should be understood by one of ordinary skill in the art that the present invention is not limited by the examples described hereinabove. The examples and descriptions described herein only illustrate the principles for this invention, and various changes and modifications may be made without departing from the spirit and scope of the present invention. Such changes and modifications are included in the scope of this invention. The claimed scope of the present invention is further illustrated by the appended claims and equivalents thereof.

What is claimed:

1. An external hanging combined vacuum on-load tap switch, comprising:

a case, a tap selector, a switching means assembly, and a transmission device, wherein one lateral side wall of the case is provided with a connecting terminal that is able to connect to a coil tap of a transformer, the lateral side wall having an external side;

the external side of the wall is provided with a first flange plate which is able to connect to a second flange plate contained in the transformer;

the tap selector and the switching means assembly are arranged inside the case in parallel;

the transmission device is able to connect to an electric operation mechanism, driving the tap selector and the switching means assembly to achieve tapping and switching;

the transmission device is arranged inside the case, the transmission device having a power input end and a power output end;

the power input end of the transmission device is able to connect to an electric operation mechanism positioned outside the case; and the transmission device comprises a combined Geneva mechanism which drives the tap selector to achieve tapping, a straight-line quick moving mechanism which drives the switching means assembly to achieve switching, and a mechanical transmission mechanism which connects the tap selector with the switching means assembly; the power output end of the mechanical transmission mechanism is connected with the straight-line quick moving mechanism; and the switching means assembly is linked with the tap selector through the straight-line quick moving mechanism.

2. The external hanging combined vacuum on-load tap switch according to claim 1, wherein said tap selector and switching means assembly are arranged vertically inside said case.

3. The external hanging combined vacuum on-load tap switch according to claim 1, further comprising a worm gear box arranged outside the case, wherein the worm gear box contains a grade gear clock indicating device; and wherein the power input end of the worm gear box is able to connect to an electric operation mechanism for receiving power; and the power output end of the worm gear box is connected with the transmission device.

4. The external hanging combined vacuum on-load tap switch according to claim 3, wherein:

the grade gear clock indicating device comprises a clock indicating plate, a clock finger, a clock finger rotating shaft, a sleeve for the rotating shaft, a driven plate, a Geneva wheel having a shaft, a driving plate having a key and an internal side and an external side, a driving plate shaft having a first end and a second end, a worm gear having a power input shaft, and a worm pole, in which the key on the worm pole is arranged on the power input shaft of the worm gear; the key on the worm gear is arranged at the first end of the driving plate shaft, while the key on the driving plate is arranged at the second end of the driving plate shaft, and the worm gear is engaged with the worm pole to transmit power;

the driving plate rotates synchronously with the worm gear; the internal side of the driving plate is provided with a column driving pin, while the external side of the driving plate is provided with a convex coupling block;

the driving plate drives the Geneva wheel to rotate through the column driving pin, and at the same time the driving plate also drives the combined Geneva mechanism through the convex coupling block; the shaft of the Geneva wheel is arranged inside the worm gear box, and the sleeve of the rotating shaft is also arranged inside the worm gear box; the rotating shaft of the clock finger passes through the sleeve of the rotating shaft; the clock finger indicating plate is fixedly arranged at one end of the sleeve of the rotating shaft positioned on the transparent cover of the worm gear box so that the change of the clock finger on the clock indicating plate is observable from the transparent cover of the worm gear box; the key on the driven plate is fixedly arranged at one end of the rotating shaft of the clock finger, and the clock finger is fixed at the other end of the rotating shaft of the clock finger, so that the driven plate can drive the clock finger through the rotating shaft of the clock finger to rotate synchronously so as to reflect the tap switch position; and the external side of the driven plate is provided with a column driven pin which is engaged with the Geneva wheel, wherein the Geneva wheel drives the driven plate to rotate intermittently through the column driven pin.

5. The external hanging combined vacuum on-load tap switch according to claim 1, wherein the switching means assembly comprises:

a switch rack having a soleplate;

a straight-line guide rail arranged at the two ends of the soleplate;

sliding blocks arranged on the straight-line guide rail;

a movable contactor bracket with two ends fixed on the sliding blocks;

three-phase movable contactors arranged on the movable contactor bracket;

three-phase static contactors and three-phase fixed contactors arranged on the switch rack, and a three-phase vacuum pipe contactor assembly arranged on the soleplate, wherein the three-phase static contactors and the three-phase fixed contactors are alternately arranged; and one end of the movable contactor bracket is connected with the straight-line quick moving mechanism and is driven by the straight-line quick moving mechanism to achieve a straight-line movement.

6. The external hanging combined vacuum on-load tap switch according to claim 5, wherein the vacuum pipe contactor assembly comprises:

a driving touch-block fixed on the lateral beam of the movable contactor bracket;

an U-shaped bracket fixed on the soleplate;

a L-shaped level swing arm arranged on the U-shaped bracket;

a touch-wheel arranged at one end of the L-shaped level swing arm;

a vacuum pipe transition contactor arranged at one end of the L-shaped level swing arm, and a reset spring arranged on the vacuum pipe transition contactor.

7. The external hanging combined vacuum on-load tap switch according to claim 1, wherein the external hanging combined vacuum on-load tap switch is capable of being adapted to a Δ connection of a second transformer.

* * * * *